US005791052A

United States Patent [19]

Bar-Or

[11] Patent Number: 5,791,052

[45] Date of Patent: Aug. 11, 1998

[54] TREE GIRDLER

[75] Inventor: Jonathan Bar-Or, Kibbutz Kfar Glikson, Israel

[73] Assignee: Juran Metal Works Ltd., Rishon Le Zion, Israel

[21] Appl. No.: 772,857

[22] Filed: Dec. 24, 1996

[30] Foreign Application Priority Data

Dec. 28, 1995 [IL] Israel ..... 116594

[51] Int. Cl.[6] ..... B26B 3/00

[52] U.S. Cl. ..... 30/121; 47/1.01; 30/280; 30/294

[58] Field of Search ..... 30/121, 280, 294; 47/1.01; 144/208.92, 340, 341

[56] References Cited

U.S. PATENT DOCUMENTS

| | | | |
|---|---|---|---|
| 278,686 | 6/1883 | Daigneau | 30/121 |
| 755,248 | 3/1904 | Sanborn | 30/121 |
| 776,691 | 12/1904 | Sanborn | 30/121 |
| 2,693,028 | 11/1954 | Stoddard | 30/121 |
| 2,760,307 | 8/1956 | Karl-Erik-Tiblom | 47/1.01 |
| 2,848,841 | 8/1958 | Kuts | 47/1.01 |
| 2,870,572 | 1/1959 | Grisset | 47/1.01 |
| 3,090,159 | 5/1963 | Wimberley | 47/1.01 |
| 4,029,134 | 6/1977 | Cook et al. | 144/208.92 |
| 4,083,106 | 4/1978 | McElroy | 30/280 |
| 4,188,718 | 2/1980 | Vredenburg, Sr. | 30/121 |
| 4,236,308 | 12/1980 | Vredenburg, Sr. | 30/121 |
| 5,257,457 | 11/1993 | Cotter | 30/121 |

FOREIGN PATENT DOCUMENTS

| | | | |
|---|---|---|---|
| 49771 | 6/1976 | Israel . | |
| 49772 | 6/1976 | Israel . | |
| 9301 | 8/1923 | Netherlands | 30/121 |

OTHER PUBLICATIONS

A. Cohen, Recent Developments in Girdling of Citrus Trees, Proc. Int. Soc. Citriculture (1981): 1: pp. 196–199.

A. Cohen, Citrus Fruit Enlargement by Means of Summer Girdling, Journal of Horticultural Science (1984): 59(1): pp. 119–125.

*Primary Examiner*—Hwei-Siu Payer

*Attorney, Agent, or Firm*—Helfgott & Karas, P.C.

[57] ABSTRACT

A girdling tool including a runner which glides along the periphery of a part of a tree; and a knife which girdles the part of the tree, the knife and the runner being angularly spaced from each other so as to define a space for positioning therein the part of the tree, wherein rotation of the runner about the knife changes the size of the space for positioning therein the part of the tree.

12 Claims, 5 Drawing Sheets

FIG. 4C
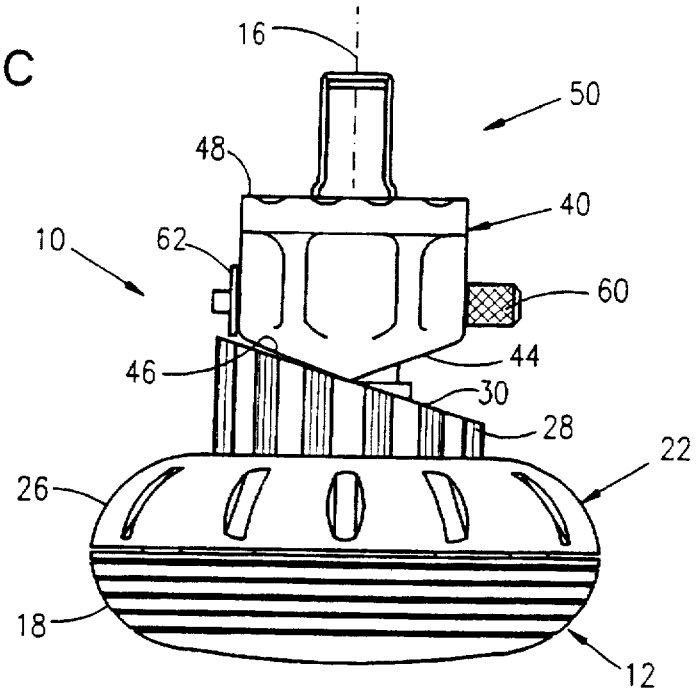
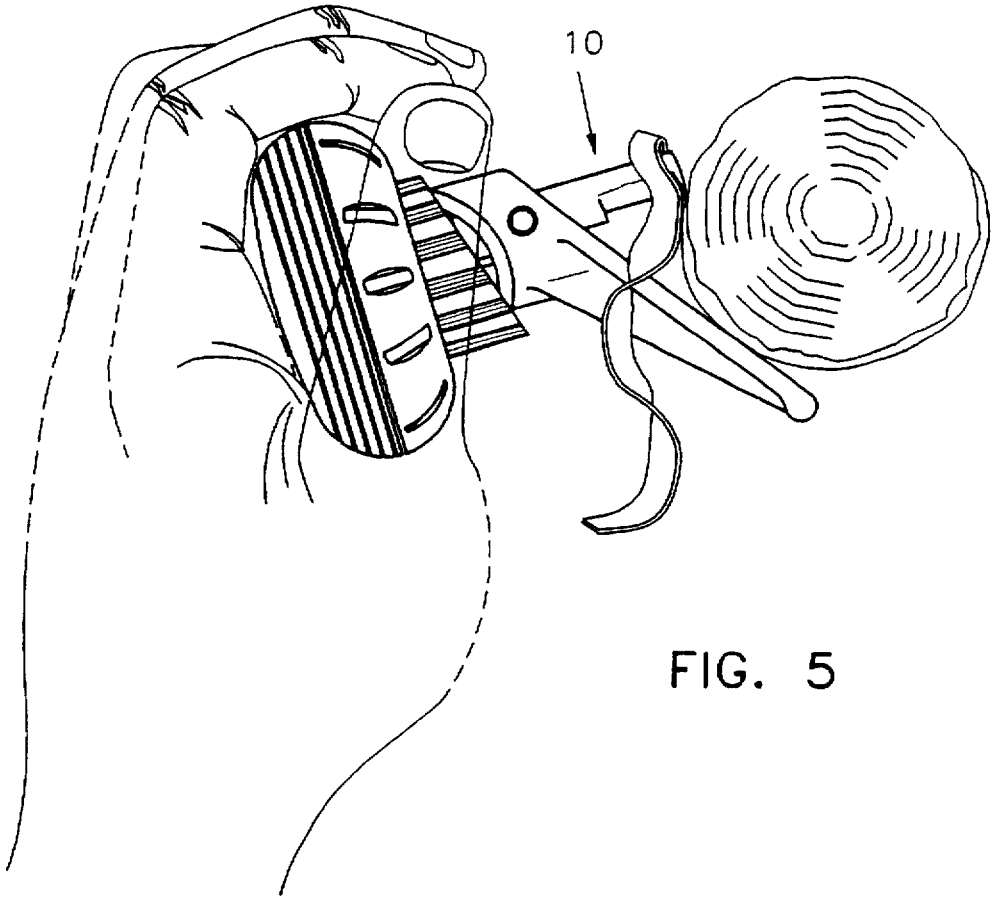
FIG. 5

TREE GIRDLER

FIELD OF THE INVENTION

The present invention relates to apparatus for girdling of trees.

BACKGROUND OF THE INVENTION

Girdling is a method of increasing yields of fruit trees and of regulating fruit size, both increasing and decreasing fruit size, by making a circumferential cut in the bark of a branch or tree trunk. A strip of bark may be removed or instead, no bark is removed, but rather a cut is made to separate the bark from the xylem, i.e., the tissue which conducts water and mineral salts from the roots to all other parts of the tree. Careful cutting of the xylem changes the conduction of water and salts to the fruits or buds to achieve the desired results.

Girdling is an old practice and is used mainly for citrus trees, as well as other trees, such as avocado and peach. Much literature has been written about girdling, such as "Recent Developments in Girdling of Citrus Trees", A. Cohen, Proc. Int. Soc. Citriculture, 1981, 1:196–199, and "Citrus Fruit Enlargement by means of Summer Girdling", A. Cohen, J. of Horticultural Science, 1984, 59(1):119–125.

Tools for removing bark and for girdling trees are known in the art. U. S. Pat. Nos. 755,248, 776,691, 2,693,028, 2,760,307, 2,848,841, 2,870,572, 3,090,159, 4,029,134, 4,188,718, and 4,236,308, and Israel Patent Applications 49771 and 49772 are believed to be representative of the art.

Girdling is traditionally performed by skilled operators, because, as mentioned above, the branch or trunk must be cut carefully. Too deep a cut may ruin growth or even kill the branch. It is thus desirable to have a tool which allows for easy and efficient girdling of trees while ensuring safety to the tree.

SUMMARY OF THE INVENTION

The present invention seeks to provide simple and improved apparatus for easy and efficient girdling of trees while ensuring safety to the tree.

There is thus provided in accordance with a preferred embodiment of the present invention, a girdling tool including a runner which glides along the periphery of a part of a tree; and a knife which girdles the part of the tree, the knife and the runner being angularly spaced from each other so as to define a space for positioning therein the part of the tree, wherein rotation of the runner about the knife changes the size of the space for positioning therein the part of the tree.

In accordance with a preferred embodiment of the present invention, the girdling tool further includes an upper handle portion, a lower handle portion, and a post fixedly attached to the lower handle portion and extending therefrom generally along a longitudinal axis, the knife being attached to the post, the runner having at least one inclined surface which is inclined with respect to the longitudinal axis, the upper handle portion having a sliding surface which is inclined with respect to the longitudinal axis, the upper handle portion being mounted on the post for rotation thereabout, and the sliding surface slidingly touching the at least one inclined surface, wherein rotation of the upper handle portion about the post causes the sliding surface to slide with respect to the at least one inclined surface, thereby changing the size of the space for positioning therein the part of the tree.

In accordance with another preferred embodiment of the present invention, the runner has at least two differently inclined surfaces each of which is adapted to slidingly touch the sliding surface, wherein rotation of the upper handle portion about the post causes the sliding surface to slide with respect to at least one of the at least two inclined surfaces, thereby changing the orientation of the runner with respect to the knife.

Additionally in accordance with a preferred embodiment of the present invention, the knife may be selectively mounted longitudinally with respect to the post.

Further in accordance with a preferred embodiment of the present invention, the girdling tool also includes an indicator for indicating rotation of the upper handle portion with respect to the post. The indicator may be audible, visual or tactile.

BRIEF DESCRIPTION OF THE DRAWINGS

The present invention will be understood and appreciated more fully from the following detailed description, taken in conjunction with the drawings in which:

FIGS. 4A, 4B and 4C are simplified front view illustrations of the girdling tool of FIG. 1, with the runner in three different orientations with respect to the knife; and FIG. 5 is a simplified pictorial illustration of the girdling tool of FIG. 1 being used to make a circumferential cut on a branch.

DETAILED DESCRIPTION OF A PREFERRED EMBODIMENT

Figure 1:
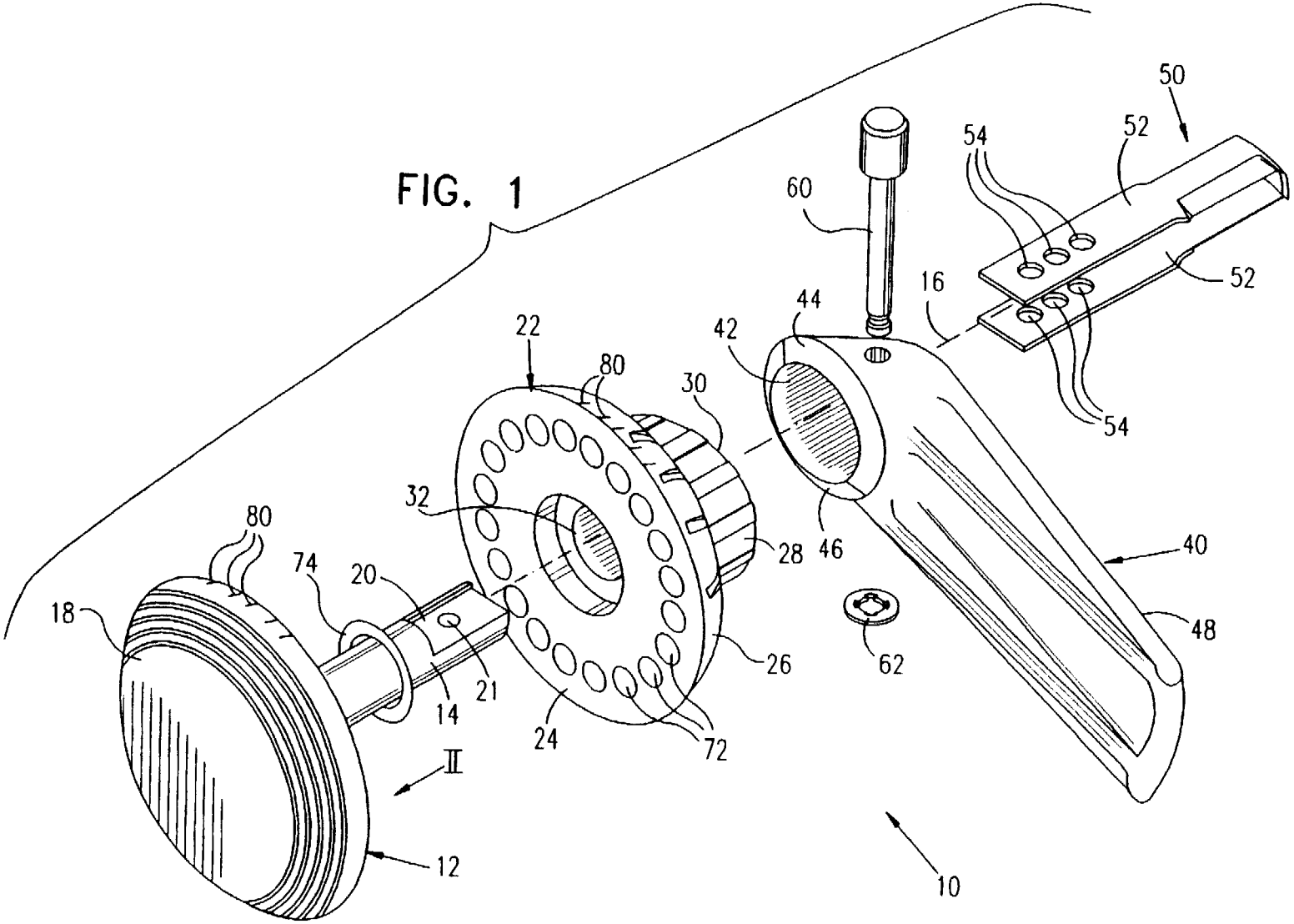
FIG. 1 is a simplified exploded pictorial illustration of a girdling tool, constructed and operative in accordance with a preferred embodiment of the present invention.

Reference is now made to FIG. 1 which illustrates a girdling tool 10 constructed and operative in accordance with a preferred embodiment of the present invention.

Figure 2A:
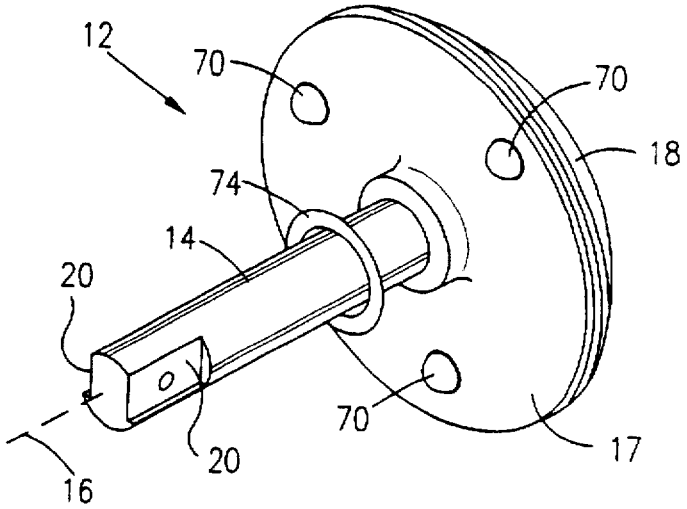
FIG. 2A is a simplified pictorial illustration of a lower handle portion of the girdling tool of FIG. 1, as viewed along arrow II in FIG. 1.

Girdling tool 10 preferably includes a lower handle portion 12, and a post 14 fixedly attached thereto and extending therefrom generally along a longitudinal axis 16, as seen additionally in FIG. 2A. Lower handle portion 12 preferably has a generally flat surface 17, and a generally spherically shaped portion 18 which is suitably sized to be comfortably held in the palm of a user (not shown). Post 14 preferably has two, oppositely facing, generally flat mounting surfaces 20 and a mounting hole 21. An alternative construction of the post is shown and described hereinbelow with reference to FIG. 2B.

Girdling tool 10 also includes an upper handle portion 22 which has a generally flat surface 24, a spherically shaped portion 26, and cylindrical portion 28 which has a sliding surface 30. Sliding surface 30 is inclined with respect to longitudinal axis 16. Upper handle portion 22 preferably has a central through hole 32, through which may pass post 14.

Girdling tool 10 also includes a runner 40 which preferably has a through hole 42 through which may pass post 14. In accordance with a preferred embodiment of the present invention, runner 40 has two inclined surfaces 44 and 46, each inclined with respect to axis 16. Each inclined surface 44 and 46 is adapted to slidingly touch inclined surface 30. Runner 40 preferably includes a branch support surface 48 which extends away from axis 16, as seen in FIG. 1.

Lower handle portion 12, post 14, upper handle portion 22 and runner 40 may be made from a suitable engineering plastic by injection molding.

Girdling tool 10 also includes a knife 50, which may be any shaped knife suitable for girdling. Knife 50 preferably includes two mounting tabs 52 and mounting holes 54. Knife 50 is attached to post 14 by fixedly attaching tabs 52 on surfaces 20, preferably by means of a pin 60 passing through one of the mounting holes 54 and mounting hole 21. Pin 60 may be secured with a retaining ring 62. Alternatively, a spring pin (not shown) may be used in place of pin 60 and retaining ring 62. In accordance with a preferred embodiment of the present invention, knife 50 may be selectively mounted on post 14, longitudinally with respect to axis 16, by selecting a different hole 54 for passing therethrough pin 60.

Figure 2B:
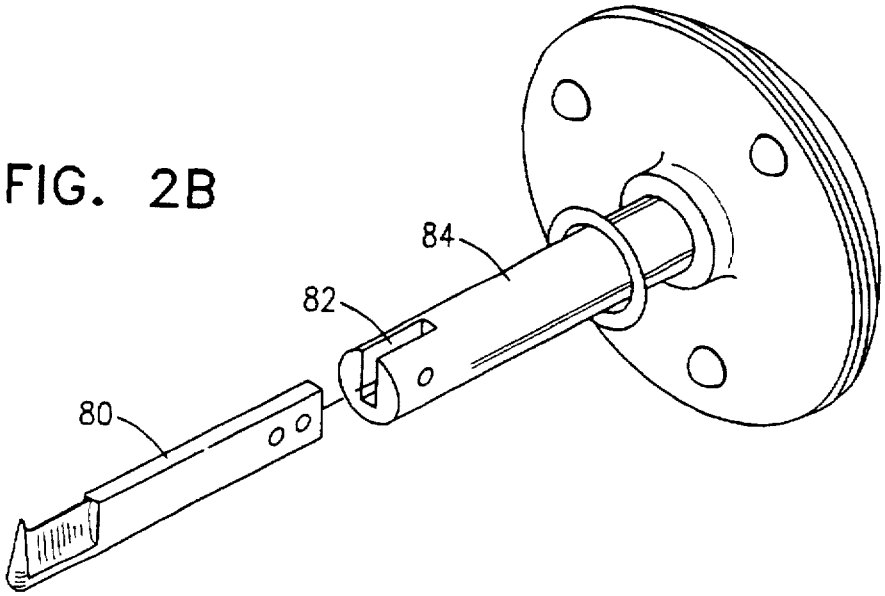
FIG. 2B is a simplified pictorial illustration of a girdling knife, constructed and operative in accordance with another preferred embodiment of the present invention.

Reference is now made to FIG. 2B which illustrates a girdling knife 80 constructed and operative in accordance with another preferred embodiment of the present invention. Girdling knife 80 may be fixedly held in a slot 82 formed in a post 84. It is appreciated that other girdling knives may be used and mounted on a post in the scope of the present invention.

Figure 3A:
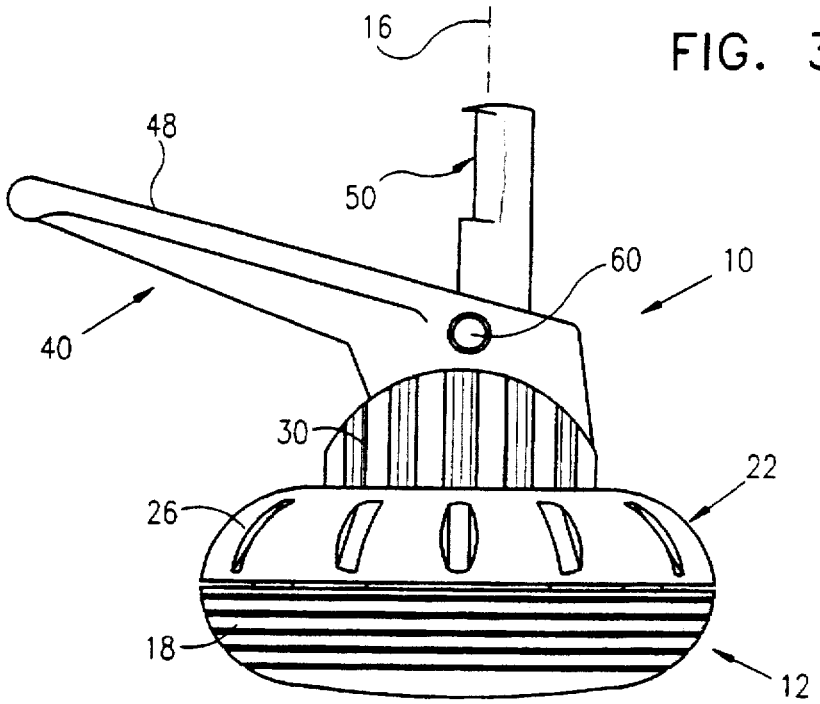
FIGS. 3A and 3B are simplified pictorial illustrations of the girdling tool of FIG. 1, with a runner in two different orientations with respect to a knife.
Figure 3B:
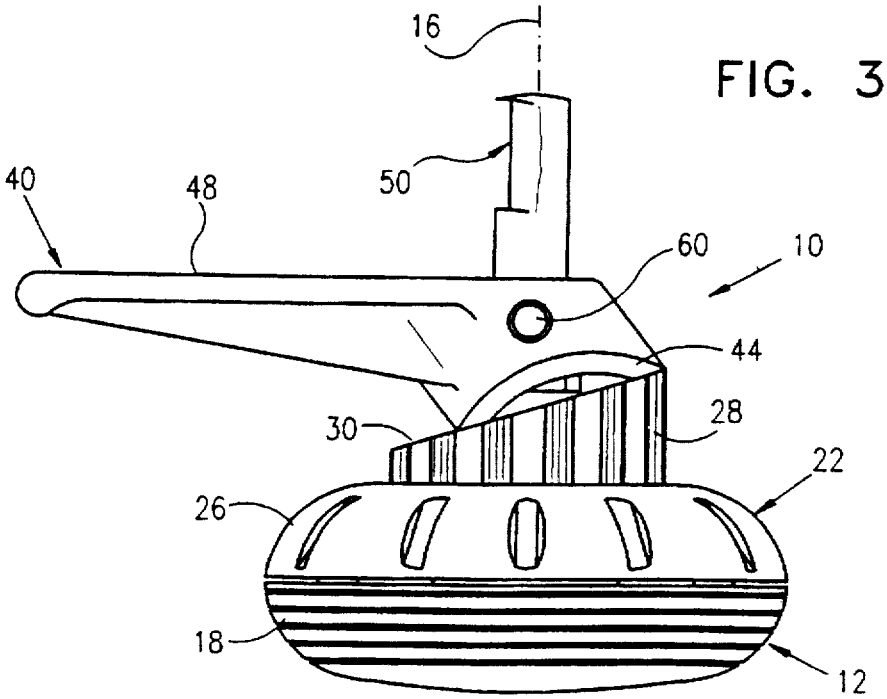
Figure 4A:
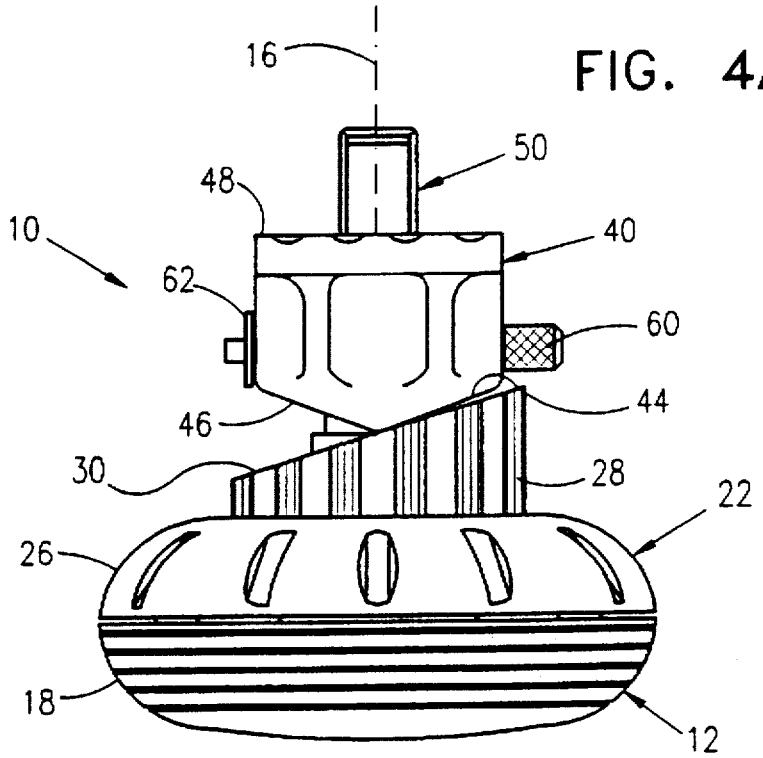
Figure 4B:
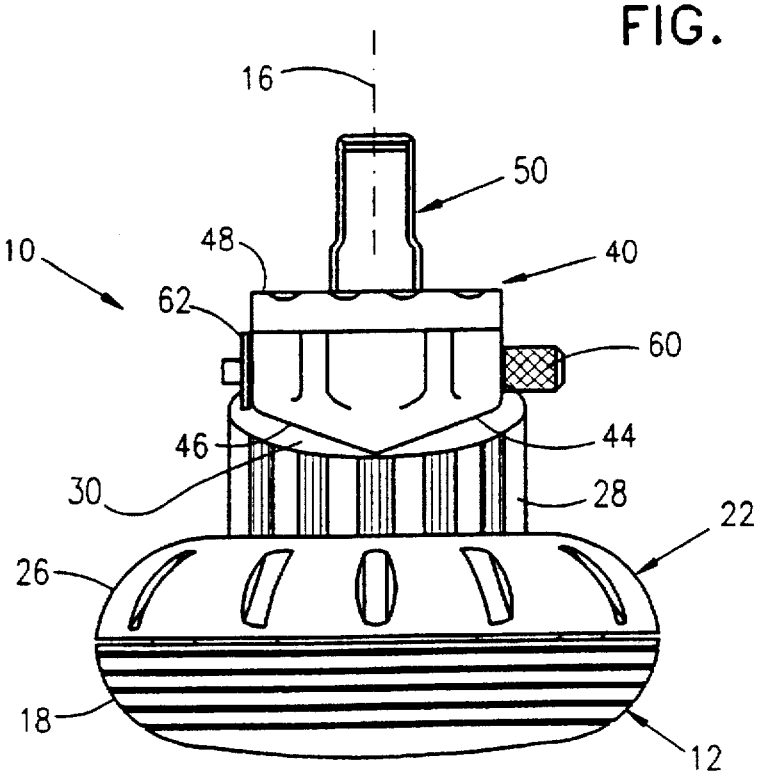

Reference is now made to FIGS. 3A and 4A which illustrate girdling tool 10 with branch support surface 48 of runner 40 in one orientation with respect to knife 50. In this orientation, inclined surface 44 rests on sliding surface 30, while inclined surface 46 does not touch sliding surface 30. By rotating upper handle portion 22 about axis 16, either clockwise or counterclockwise, sliding surface 30 slides with respect to inclined surface 44, thereby changing the orientation of branch support surface 48 of runner 40 with respect to knife 50, such as the orientation illustrated in FIGS. 3B and 4B.

As seen in FIG. 4C, upper handle portion 22 may be further rotated about axis 16 such that inclined surface 46 rests on sliding surface 30, while inclined surface 44 does not touch sliding surface 30. Inclined surface 44 may be inclined at a different angle with respect to axis 16 than inclined surface 46, in which case the orientation of branch support surface 48 of runner 40 with respect to knife 50 shown in FIG. 4C is different than the orientation of FIG. 4A.

In accordance with a preferred embodiment of the present invention, girdling tool 10 may be provided with an indicator for indicating rotation of upper handle portion 22 with respect to post 14. Referring again to FIGS. 1 and 2, it is seen that lower handle portion 12 may be provided with a set of balls 70 entrapped on surface 17, and radially space from axis 16. Upper handle portion 22 may have a set of spherical depressions 72 formed on surface 24 and spaced from axis 16 substantially the same distance as balls 70. At any given working orientation of upper handle portion 22 with respect to lower handle portion 12, balls 70 seat in corresponding depressions 72, thereby helping to maintain the particular chosen orientation. When upper handle portion 22 is rotated about post 14, balls 70 are alternately unseated from and seated in depressions 72, thereby causing a "clicking" sound which provides an audible indication of the rotation of upper handle portion 22. A spring washer 74 may be mounted on post 14 for facilitating rotation of upper handle portion 22 by biasing against surfaces 17 and 24, thereby making it easier for balls 70 to be unseated from depressions 72 due to the biasing force which helps separate lower handle portion 12 from upper handle portion 22 during rotation.

Alternatively or additionally, in accordance with a preferred embodiment of the present invention, markings 80 may be provided on either lower handle portion 12 or upper handle portion 22 which give a visual indication of rotation of upper handle portion 22 with respect to post 14.

Reference is now made to FIG. 5 which is a simplified pictorial illustration of girdling tool 10 being used to make a circumferential cut on a branch.

It will be appreciated by persons skilled in the art that the present invention is not limited by what has been particularly shown and described hereinabove. Rather the scope of present invention is defined only by the claims which follow:

I claim:

1. A girdling tool comprising:

a runner which glides along the periphery of a part of a tree and has a central portion and an extension portion:

a knife which girdles said part of said tree, said knife and said runner extension portion being angularly spaced from each other so as to define a space for positioning therein said part of said tree, said runner central portion being arranged to rotate about a longitudinal axis of said knife, wherein rotation of said runner about said knife changes the size of said space for positioning therein said part of said tree.

2. A girdling tool according to claim 1 and further comprising:

an upper handle portion;

a lower handle portion; and a post fixedly attached to said lower handle portion and extending therefrom generally along a longitudinal axis of said post, said knife being attached to said post;

said runner central portion having an inclined annular surface which is inclined with respect to said longitudinal axis of said post, said upper handle portion having a sliding annular surface which is inclined with respect to said longitudinal axis of said post, said upper handle portion being mounted on said post for rotation thereabout, and said sliding surface slidingly touching said inclined runner surface;

wherein rotation of said upper handle portion about said post causes said sliding surface to slide with respect to said inclined runner surface, thereby changing the size of said space for positioning therein said part of said tree.

3. A girdling tool according to claim 2 and wherein said runner annular surface has at least two differently inclined surfaces each of which slidingly touches said sliding surface, wherein rotation of said upper handle portion about said post causes said sliding surface to slide with respect to at least one of said at least two inclined surfaces, thereby changing the size of said space for positioning therein said part of said tree.

4. A girdling tool according to claim 3 and comprising an indicator for indicating rotation of said upper handle portion with respect to said post.

5. A girdling tool according to claim 4 and wherein said indicator is audible.

6. A girdling tool according to claim 4 and wherein said indicator is visual.

7. A girdling tool according to claim 4 and wherein said indicator is tactile.

8. A girdling tool according to claim 2, and wherein said knife is selectively mountable longitudinally with respect to said post.

9. A girdling tool according to claim 2 and comprising an indicator for indicating rotation of said upper handle portion with respect to said post.

10. A girdling tool according to claim 9 and wherein said indicator is audible.

11. A girdling tool according to claim 9 and wherein said indicator is visual.

12. A girdling tool according to claim 9 and wherein said indicator is tactile.

* * * * *